United States Patent [19]

Rose

[11] 4,305,166

[45] Dec. 15, 1981

[54] REVERSIBLE SINK COVER

[76] Inventor: Virginia Rose, 10 Vladish Ave., Turners Falls, Mass. 01376

[21] Appl. No.: 147,570

[22] Filed: May 8, 1980

[51] Int. Cl.[3] ..... E03C 1/33

[52] U.S. Cl. ..... 4/631; 4/637

[58] Field of Search ..... 4/630, 631, 661, 632–640, 4/587; 99/626; 312/237, 241

[56] References Cited

U.S. PATENT DOCUMENTS

| | | | |
|---|---|---|---|
| 947,609 | 1/1910 | Betzold | 4/637 X |
| 964,857 | 7/1910 | Fredenhagen | 4/637 X |
| 1,115,968 | 11/1914 | Park | 4/587 X |
| 1,134,696 | 4/1915 | Nemec | 4/631 X |
| 2,308,123 | 1/1943 | Stein | 4/638 |
| 2,314,157 | 3/1943 | O'Brien | 4/631 |
| 2,579,393 | 12/1951 | Modrey | 99/626 |
| 3,331,647 | 7/1967 | Struebin et al. | 312/241 |
| 3,873,114 | 3/1975 | Brown | 312/237 X |
| 3,983,583 | 10/1976 | Herman et al. | 4/630 X |
| 3,993,376 | 11/1976 | Meldahl | 4/630 X |

*Primary Examiner*—Henry K. Artis

[57] ABSTRACT

A reversible sink cover adapted to fit onto the well of a kitchen sink to cover the sink when not in use. The underside of the cover is provided with a suitable kitchen tool, such as a dish drying rack or cutting board and the outer surface of the cover may include an ornamental design. The cover has a plurality of magnets to removably secure it to a metal sink.

7 Claims, 4 Drawing Figures

REVERSIBLE SINK COVER

BACKGROUND OF THE INVENTION

The present invention relates generally to reversible sink covers. More particularly, it relates to a sink cover that can be removed from a kitchen sink and flipped over to expose a kitchen tool integral therewith.

Numerous kitchen duties are often performed near or at the kitchen sink. Obviously, some such duties, such as washing dishes, require use of the sink itself while others have no functional relation to the sink. Nonetheless, such other chores are invariably performed on the kitchen counter, e.g., the cutting of meat.

Many fastidious homemakers find the appearance of the kitchen sink unsightly no matter how well scoured or cared for. Generally, such persons would prefer to conceal or cover over the kitchen sink by means of a suitable and versatile cover if available and particularly one which could be used to conceal "dirty dishes" in the sink in the case of the dinnertime caller.

Some prior patents have dealt with the problem of providing ready access to kitchen equipment but have not coped with the problem of dirty dishes in the sink. For example, U.S. Pat. No. 2,579,393 (a patent to H. J. Modrey) discloses a relatively flat kitchen aid supported during its use and storage by the counter top adjacent a sink. The kitchen aid has two sides: one a drainboard, the other a cutting board. Other prior inventions have dealt with sink covers but have not completely solved the problem of providing easy access to kitchen tools. For example, U.S. Pat. No. 2,314,157 (a patent to V. R. O'Brien) discloses a sink cover which hides the contents in a sink and which inverts to provide a draining board; however, the cover does not include an attached dish rack. Consequently, the rack must be separately stored.

SUMMARY OF THE INVENTION

The present invention overcomes drawbacks discussed above. In general, the invention comprises a sink cover with two sides: one side having a handle, the other side providing a kitchen aid sized to fit within the well of the sink. When the cover fits over a sink, the handle side is the upper side.

When desired, the kitchen aid, such as a dish rack, can be used by lifting the cover from a covered sink, turning it over and placing the flat side down. The dish rack is thus ready for use. After the rack is used, the cover may be flipped over again and placed on the sink. The rack is thus stored out of sight but ready for immediate use.

In the preferred embodiment, the sink cover includes a sheet of plastic with two parallel sides; the handle side has an ornamental design, and the attached kitchen aid includes a dish rack. Further, the kitchen tool side preferably includes magnets disposed along its periphery for removably retaining the cover in place on the sink.

In another embodiment, the kitchen aid is a wooden cutting board.

Accordingly, the principal object of this invention is to provide a removable sink cover which includes a kitchen aid on one side thereof.

Another object of this invention is to provide a sink cover integrally combined with a kitchen aid that is of simple and economic construction yet easy to use.

The above and other objects and advantages of the disclosed invention will become more readily apparent when reference is made to the following description taken in conjunction with the accompanying drawings.

DETAILED DESCRIPTION OF THE DRAWINGS

Figure 1:
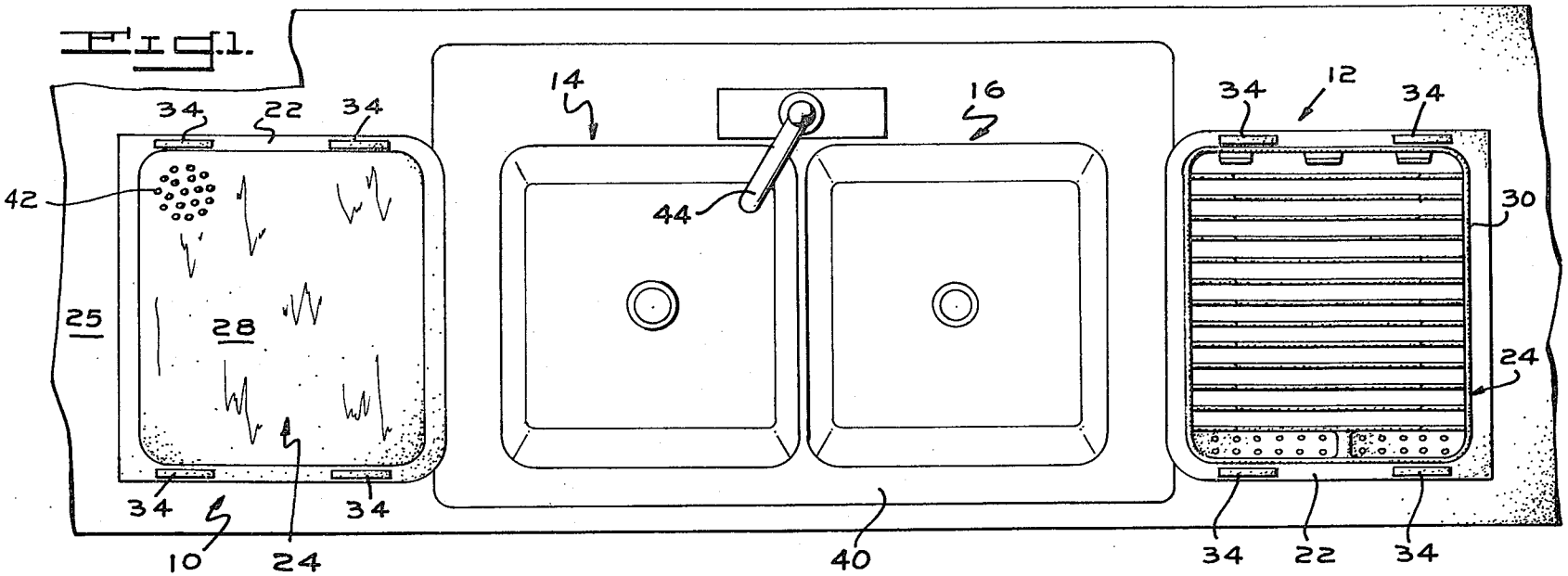
FIG. 1 is a top plan view of double sink with two sink covers resting against a counter top of the sink covers embodying the present invention.

Referring to the drawings, a pair of sink covers 10, 12 are shown being used in conjunction with a double sink having two well portions 14 and 16. The sink covers 10, 12 each have two parallel sides: one side 18 being shown imprinted with an optional ornamental design 20, the other side 22 having an attached kitchen aid or tool 24, in the embodiment shown being a dish rack. The covers 10, 12 are separate from the double sink and can be used to cover completely the double sink (see FIG. 3). The covers are completely removable and can be reversed and disposed on the counter top 25 adjacent the sink.

Figure 3:
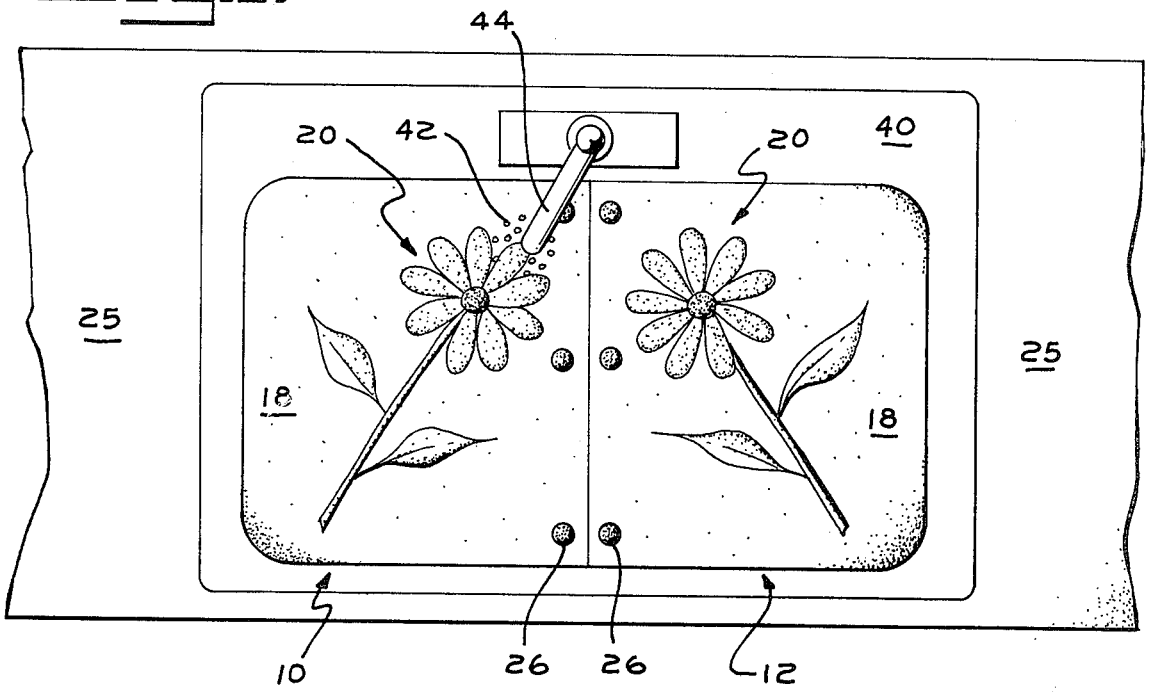
FIG. 3 is a plan view of the FIG. 1 covers reversed for covering the double sink.
Figure 4:
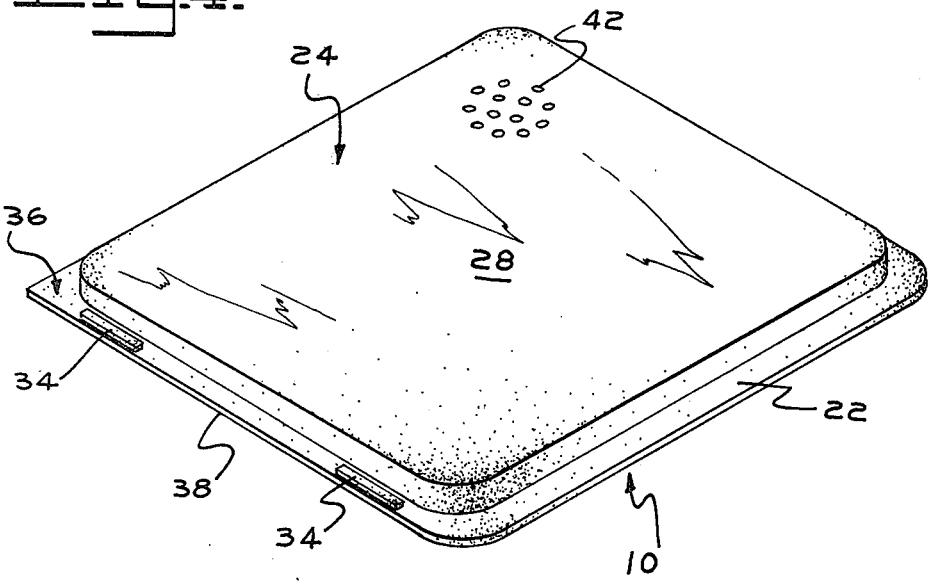
FIG. 4 is a perspective view showing one of the covers.

The sink covers are preferably formed of suitable synthetic plastic material. As shown in FIG. 3, when a sink is covered, the ornamental side 18 is in view while the other side 22 is, of course, out of view. The ornamental side includes a plurality of spaced knobs or bosses 26 that serve as handles for manipulating the covers.

As shown in FIG. 1, there are two preferred kitchen tools 24. One is a cutting board 28, preferably formed of wood, attached to the cover by any suitable fastener means. The other is a plastic dish rack 30, which, though not illustrated, can be made collapsible, and an underlying rubber mat 32. By making the dish rack collapsible, the cover can be adapted to hide a sink full of dishes with the rack on the underside of the cover. The tools are each sized to fit within the confines of the perimeter of the sink well 14 and 16. Further, they are each spaced within and from the perimeters of the sides 22.

When the ornamental side 18 of the cover 12 is resting against the counter top 25, the knobs 26 cause the parallel sides 18 and 22 to be tilted which causes the rubber mat 32 to act as a drainboard. Water runs down the mat into the adjacent sink 16.

Each cover side 22 includes magnet means 34 disposed along its rim 36 between the perimeter 38 of the cover and the attached tool 24. These magnets serve to releasably retain the cover in place on the edge of a metal sink or a ceramic covered metal sink which are the most common present-day constructions.

Figure 2:
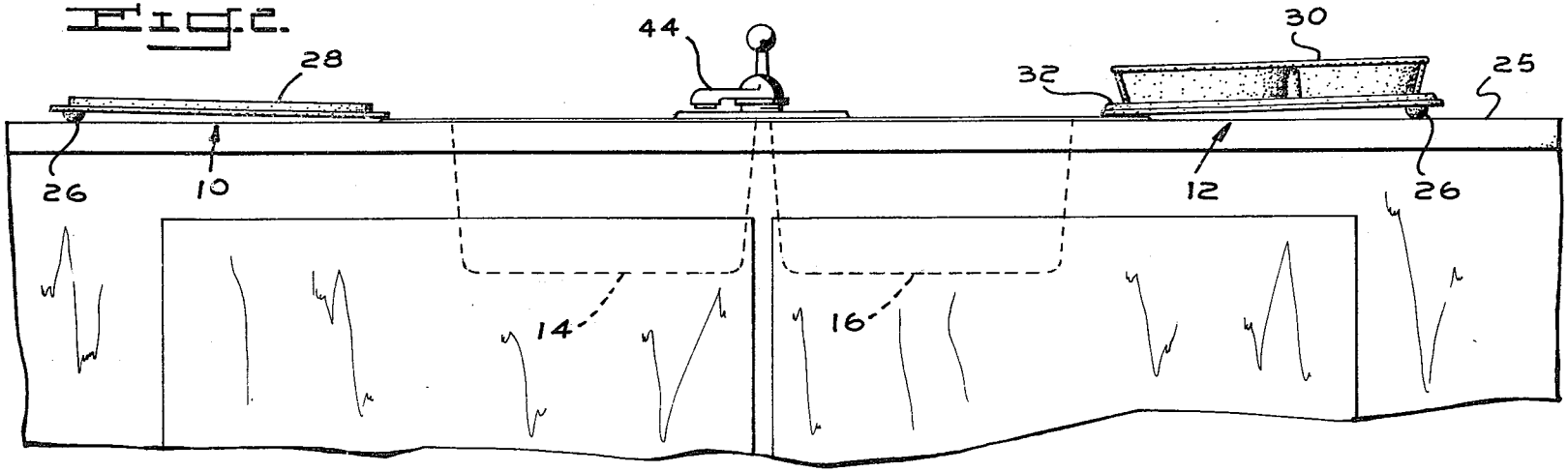
FIG. 2 is an elevational view corresponding to FIG. 1.

As best shown in FIG. 3, the cover 10 includes perforations 42 for permitting water to drain through the cover into the sink. Such perforations are inappropriate for cover 12 because, in the FIG. 2 position of that cover, water from wet dishes in the rack 30 would drip through the perforations and onto the countertop 25, instead of draining into adjacent sink 16.

While two different embodiments of the present invention have been disclosed, it should be understood that obvious structural modifications can be made without departing from the spirit of the invention. Further, it should be understood that each of the disclosed covers can be used in connection with a single, rather than a double, kitchen sink. Accordingly, reference should be made primarily to the accompanying claims, rather than to the specification, to determine the scope of the invention:

Having thus described the invention, what is claimed is:

1. Sink cover formed of a synthetic plastic material with a generally planar upper surface and carrying on its undersurface at least one type of kitchen working aid, such cover being dimensioned so that its peripheral edge fits onto the edges of a kitchen sink for removably covering the sink with the underside of the cover disposed in spaced relation to the bottom surface of said sink and defining a closed chamber therewith, said kitchen aid being dimensioned to fit wholly within said sink when the planar surface is disposed upwardly in sink covering position, said cover being separable from said sink and reversible for positioning the kitchen aid upwardly and the planar side downward.

2. Sink cover as set forth in claim 1 wherein the planar side of said cover includes raised portions integral therewith which serve as handle means for manipulating this cover, said raised portions being disposed to cause said cover to tilt when disposed on a counter top whereby liquid will drain toward the sink adjacent said cover.

3. Sink cover as set forth in claim 2 wherein said cover includes drain perforations therethrough.

4. Sink cover as set forth in claim 2 wherein the undersurface of said cover includes a depending rim portion dimensioned to fit within the upper edge portions of said sink for holding said cover firmly in position on said sink.

5. Sink cover as set forth in claim 2 wherein magnet means are disposed along outer edge portions of the cover for releasably holding the same in place on a sink which is formed of a ferromagnetic material.

6. A sink cover comprising:

(a) a synthetic plastic molding;

(b) a cutting board carried on one side thereof, said board being spaced within and from the perimeter of said one side;

(c) handle means integral with the other side;

(d) the side with the handle being generally planar and adapted to overlie the perimeter of a sink so that only said planar side is exposed to view; and (e) the cutting board being adapted in size to fit within the perimeter of the sink when the handle side covers the sink.

7. The sink cover of claim 6 wherein the plastic member has a plurality of holes adapted to permit drainage of water therethrough.

* * * * *